United States Patent [19]

Amburgey

[11] 4,121,828

[45] Oct. 24, 1978

[54] BOWLING BALL

[76] Inventor: Jay Dee Amburgey, 1710 N. Dotsy, Odessa, Tex. 79761

[21] Appl. No.: 842,566

[22] Filed: Oct. 17, 1977

Related U.S. Application Data

[63] Continuation-in-part of Ser. No. 649,054, Jan. 4, 1976, abandoned.

[51] Int. Cl.[2] ..... A63B 37/10

[52] U.S. Cl. ..... 273/63 E; 273/63 C

[58] Field of Search ..... 273/63, 213, DIG. 20, 273/128 A, 199 R, 183 C

[56] References Cited

U.S. PATENT DOCUMENTS

| | | | |
|---|---|---|---|
| 189,674 | 4/1877 | Woods | 273/63 E |
| 2,035,975 | 3/1936 | Meyer | 273/63 E |
| 2,291,738 | 8/1942 | Luth et al. | 273/63 E |
| 3,181,864 | 5/1965 | Rolke | 273/63 E |
| 3,318,598 | 5/1967 | Ruskin | 273/63 C |
| 3,331,605 | 7/1967 | Special | 273/213 |
| 3,441,274 | 4/1969 | Collins | 273/63 E |
| 3,865,369 | 2/1975 | Randolph | 273/63 E |

*Primary Examiner*—George J. Marlo
*Attorney, Agent, or Firm*—Marcus L. Bates

[57] ABSTRACT

A solid bowling ball contains a top weight distributed along a weight plane and underlying indicia on the top surface which designates the position of the weight plane. The top weight includes two major masses spaced apart a distance such that the top weight commences and ends within less than 180 degrees of curvature. The top weight offsets the weight loss resulting from forming the finger holes and also produces a gyroscopic stabilizing effect when the ball is rolled along the plane of the top weight.

10 Claims, 15 Drawing Figures

BOWLING BALL

REFERENCE TO RELATED PATENT APPLICATION

This patent application is a continuation in part of my copending Patent Application Ser. No. 649,054, filed Jan. 4, 1976 now abandoned.

BACKGROUND OF THE INVENTION

Bowling balls are generally manufactured such that the ball is slightly denser adjacent the top of the ball, so that when finger holes are custom fitted into the top of the ball, proper balance about the various axis of the ball is achieved. Various finger holes require the removal of different amounts of mass; and accordingly, the resultant weight of one ball for one particular bowler will differ from the resultant weight of the same ball for a different bowler because of the difference in the masses removed from the top of the ball during the formation of the finger holes.

The finger holes of a bowling ball must therefore be placed in superimposed relationship respective to the area in which the underlying top weight is located. The finger holes usually extend into the top weight and the top weight must be of a density which partially compensates for the removal of material therefrom. However, within a particular geometrical area which describes the underlying top weight, it is customary to indiscriminately place the finger holes into the ball with no regard to the direction within which the ball is to be thrown or rolled. Hence, in custom fitting one's hand to a bowling ball, no one heretofore has considered the dynamic properties of the ball. For example, it is quite possible for one to select two identical bowling balls, form the finger holes in properly indexed relationship respective to the top weight, and yet end up with the finger holes arranged a substantial amount out of phase with one another, so far as regards the dynamic stability of the ball.

Many skilled in the art of bowling balls consider that a perfect bowling ball is one which is perfectly balanced, that the material removed during formation of the finger holes is precisely superimposed in the precise geometrical center of a symmetrical body of denser material, and that the surface of the bowling ball should be absolutely spherical. In actual practice, such a bowling ball is achieved through accident rather than design for the reason that the finger holes seldom are placed as one envisions, nor is the distribution of mass within the ball absolutely perfect. Accordingly, it is almost impossible for one to drill finger holes within two identical bowling balls and for the bowling balls to subsequently perform identically respective to one another, although the same expert player may be rolling the balls.

Therefore, when a bowler finds a suitable ball with which he can consistently roll a high score, it is catastrophic when, for one reason or another, he must abandon his old bowling ball in favor of a new ball.

It would therefore be advantageous if one could provide a bowling ball whose dynamic stability characteristics are such that the ball would travel down the bowling lane in an improved and reproduceable manner, and upon striking the pins, the ball would continue to travel in the same direction, so that once the bowler learns to roll the ball in such a manner that he can obtain a strike, he could thereafter have other balls drilled in accordance with the present invention and always expect the other balls to react in the same identical manner. Such an expedient is the subject of the present invention.

Bowling balls often must be of a specific weight and size, or lie within a certain specified range of weights and sizes, in order to compete in national competition. Moreover, the material of construction, as well as the weight distribution of the mass of the ball, must comply with the specifications formulated by the National Bowling League.

SUMMARY OF THE INVENTION

Method and apparatus pertaining to the fabrication of and improvements in bowling balls, comprising redistributing the weight within a bowling ball such that the dynamic stability of the ball is vastly improved. The invention is achieved by redistributing the top weight of a bowling ball so that the top weight offsets the loss in weight resulting from drilling the finger holes, and additionally improves the performance of the ball. The top weight is redistributed in such a manner that when the ball is rolled, the top weight describes a plane which always lies parallel to the rolling plane or normal to the rolling axis of the ball.

In one embodiment of the invention, a disk core is positioned within the ball and disposed normal to the rolling axis thereof, and the top weight is arranged within the outer marginal edge of the disk core in underlying relationship respective to the finger holes, and further, the mass of the top weight is greater than the mass of the disk, and the mass of the disk is greater than the main body of the ball. This expedient stabilizes the ball in an unexpected manner so that the ball not only travels down the bowling lane in an improved manner; but furthermore, the impact of the ball against the pins does not deflect the ball. Accordingly, the direction of travel of the ball does not change. Consequently, each time the ball is properly rolled, it will react in the same reproduceable manner and strike the pins in an improved manner.

In order to assure proper placement of the finger holes respective to the location of the redistributed mass within the bowling ball, indicia is placed on the surface of the ball, indicating not only the proper area within which a finger hole should be drilled; but furthermore, indicating the precise indexed relationship which must be achieved so that when the ball is initially rolled, it will leave the bowler's hand, commence rolling down the bowling lane, with the redistributed mass forming an imaginary plane which lies normal to the rolling axis of the ball.

Accordingly, a primary object of this invention is the provision of improved dynamic stability characteristics within a bowling ball.

Another object of the invention is the provision of a means by which the top weight of a bowling ball can be redistributed to improve the dynamic stability thereof.

A further object of this invention is to disclose and provide a stabilizing element placed within a bowling ball such that when the ball is rolled, the internal weight describes a plane which is parallel to the rolling plane of the ball.

A still further object of this invention is to provide an improved bowling ball having a plurality of masses located therewithin which stabilize the ball as it rolls down the bowling lane and furthermore causes the ball to remain in balance respective to its weight distribution.

Another and still further object is the provision of a method of building a bowling ball such that the resultant ball is balanced, and the weight distribution thereof is arranged in a manner to improve the dynamic stability characteristics thereof.

An additional object is the provision of a method of redistributing the weight within a bowling ball such that the ball remains in balance and also travels down the lane and strikes the pins in an improved manner.

Another object is the provision of a method of redistributing and adding to a bowling ball different density of materials such that when the bowling ball is properly rolled, it leaves the player's hand and rolls down the lane in a new and improved manner.

These and various other objects and advantages of the invention will become readily apparent to those skilled in the art upon reading the following detailed description and claims and by referring to the accompanying drawings.

The above objects are attained in accordance with the present invention by the provision of a method of building and improvements in the dynamic stability characteristics of a bowling ball in a manner substantially as described in the above abstract and summary.

DETAILED DESCRIPTION OF THE PREFERRED EMBODIMENT

Figure 1:
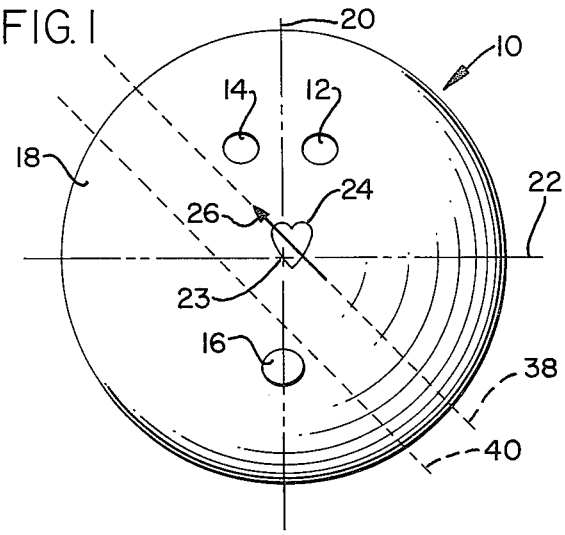
FIG. 1 represents a perspective view of a bowling ball made in accordance with the present invention.
Figure 2:
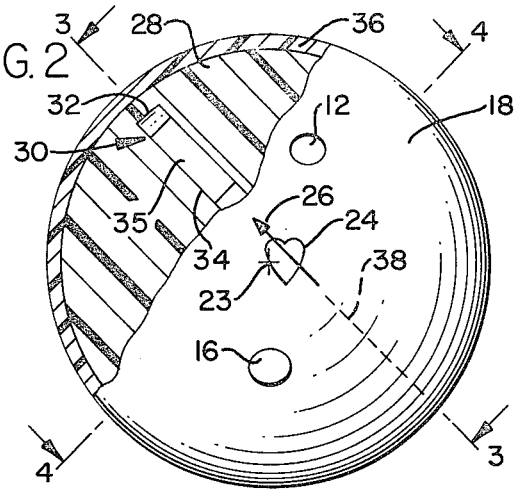
FIG. 2 is a part cross-sectional representation of the bowling ball disclosed in FIG. 1.
Figure 3:
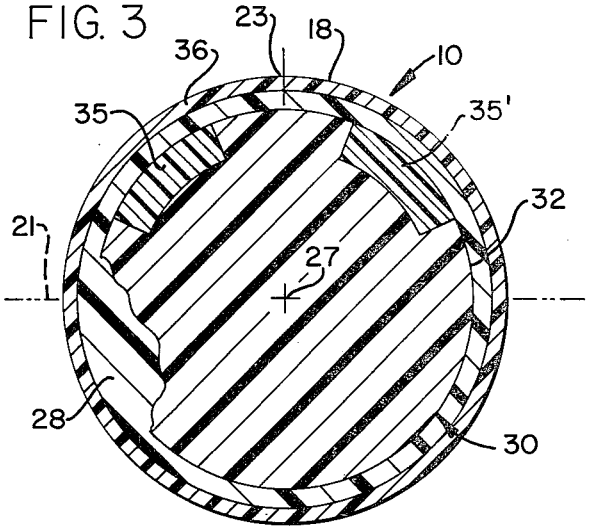
FIG. 3 is a cross-sectional view taken along line 3—3 of FIG. 2, with some parts thereof being broken away to more clearly disclose the invention.

In the figures of the drawings, like or similar numerals, wherever logical or practical to do so, will relate to like or similar elements.

In describing the preferred embodiment of the invention, the bowling ball will be related to a person who bowls right handed.

In the embodiment of the invention disclosed in FIGS. 1–4, a bowling ball 10 is provided with the usual ring finger hole 12, a middle finger hole 14, and thumb hole 16. Apertures 12, 14, and 16 will hereinafter sometimes be referred to as the gripping holes. The bowling ball has the usual attractive, smooth, outer spherical finish or surface 18. Numeral 20 indicates a vertical plane herinafter referred to as the Y-plane. Numeral 21 is the equatorial plane or midhorizontal plane of the ball disclosed in FIG. 1, while numeral 22 indicates the X-axis or X-plane of the ball. Hence, vertical planes 20 and 22 are disposed normal to one another, while the equatorial plane is disposed normal to the X and Y-axis. Numeral 23 indicates the intersect of the X and Y-planes, and forms the axial vertical centerline of the ball, while numerals 24 and 26 relate to indicia placed upon the bowling ball for indexing purposes. Numeral 27 indicates the geometrical center of the bowling ball.

The bowling ball of FIGS. 1–4 is solid and is provided with a rubberlike or plastic interior 28, within which there is embedded a mass 30 of rubberlike or plastic material having a density greater than the main body 28. The mass 30 is in the form of a disk core having an outer, circumferentially extending surface 32 and a side 34. Two spaced segments 35, 35' of an annulus are placed within complementary cutouts formed within the outer marginal edge of the disk core. The density of the segments is greater than the density of the disk core.

The main body is provided with a plastic or rubberlike covering 36 in the usual manner, although in some instances the main body will extend to the surface if the manufacturer considers the main body material to be of adequate hardness to achieve this design expedient. The apparent rolling plane 38 of the ball is seen to coincide with indicia 26, as well as describing a weight plane which is the midcircumference of the disk core 30. In other words, the arrow 26, if extended, describes a circle about the ball which is concentrically arranged with respect to the weight plane and with the outer circumference of the disk core 30.

Figure 4:
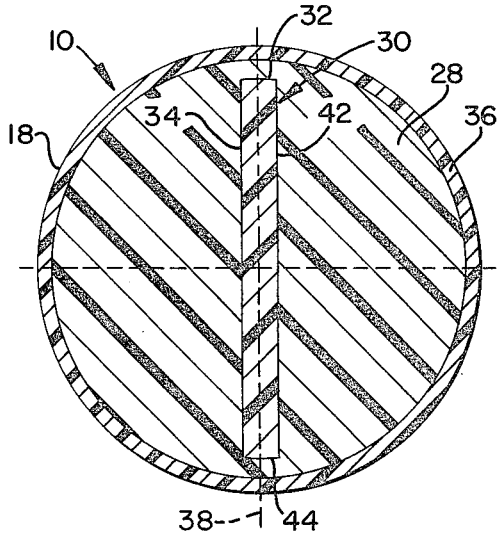
FIG. 4 is a cross-sectional view taken along line 4—4 of FIG. 2.

As best seen illustrated in FIG. 4, the opposed side 42 of the disk core is parallel to side 34 thereof. As indicated by the numeral 44, the outer, circumferentially extending surface of the disk core is equally spaced from the outer surface of the ball. As further seen in FIG. 4, the apparent rolling plane 38 of the ball forms an imaginary plane which is parallel to and bisects the disk core.

Figure 5:
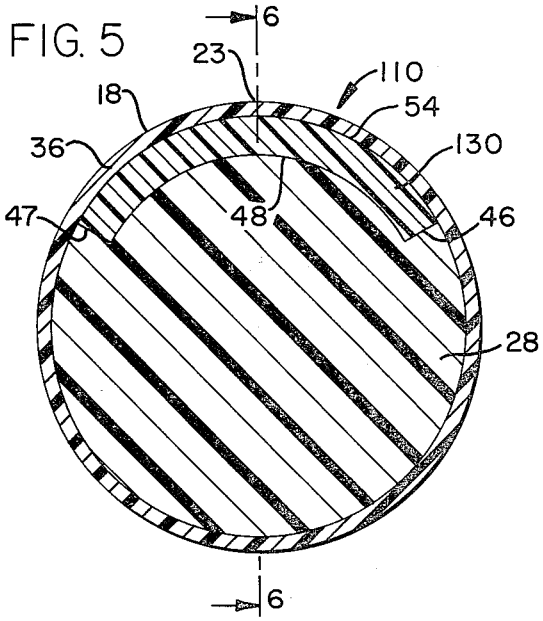
FIG. 5 is a cross-sectional view which sets forth a second embodiment of the invention.
Figure 6:
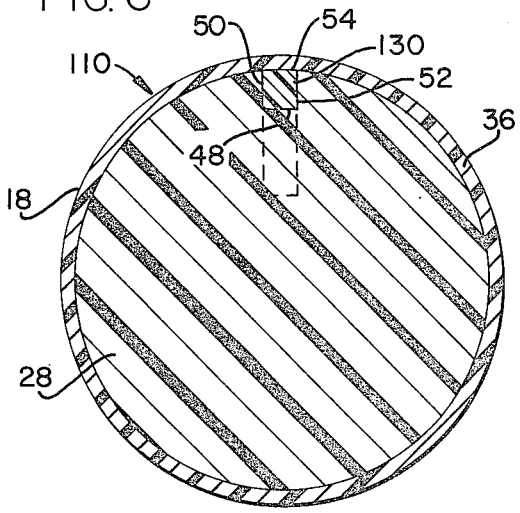
FIG. 6 is a cross-sectional view, taken along line 6—6 of FIG. 5.

In the embodiment of FIGS. 5 and 6, a segment 130 of an annular disk is embedded within the main body 28 of a bowling ball. Opposed ends 46 and 47 of the segment are spaced from one another and extend approximately 90° about the circumference and parallel to or concentric with the plane 38. The medial portion of the segment is arranged in underlying relationship respective to the vertical axis or intersect 23. The minor diameter 48 of the segment is spaced from the geometrical center of the ball, and preferably is closer to the surface than to the center 27 for achieving optimum weight distribution.

Figure 7:
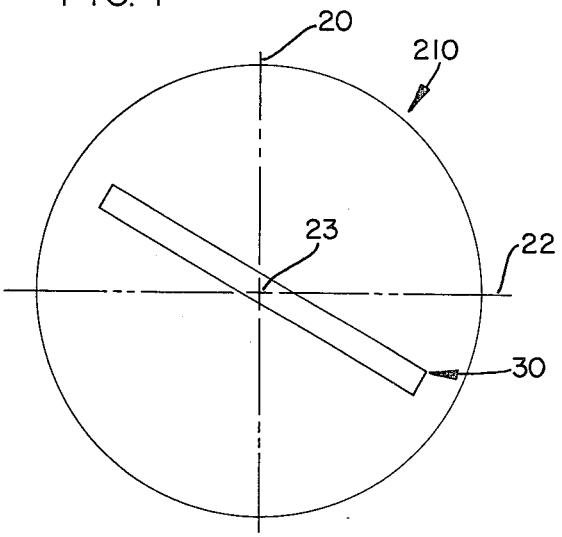
FIGS. 7 and 8 are diagrammatical representations of the bowling ball seen disclosed in any of the foregoing figures.
Figure 8:
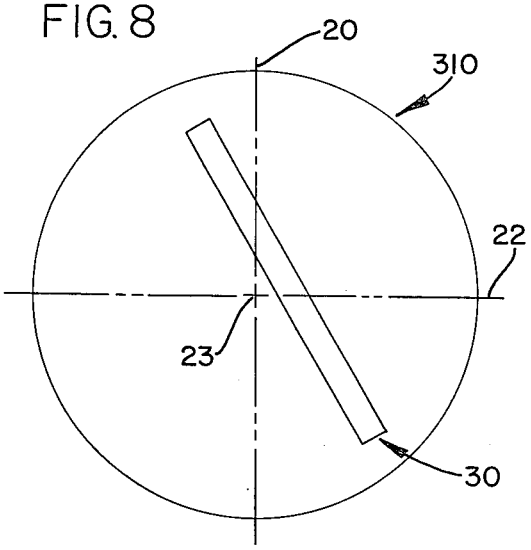

FIGS. 7 and 8 are schematical representations of a bowling ball made in accordance with the various different embodiments of this invention. As seen in FIG. 7, the stabilizing mass 30 is arranged at an angle of about 30° respective to the X-axis and 60° respective to the Y-axis; and furthermore, the stabilizing mass is arranged in a plane which is parallel to or coincides with the vertical axis 23.

In FIG. 8, the stabilizing mass is seen to be spaced slightly from the vertical axis 23 and disposed at an angle of about 60° respective to the X-axis and 30° respective to the Y-axis.

FIGS. 7 and 8 jointly illustrate, in a diagrammatical manner, a bowling ball 210 and 310, wherein the limits within which the stabilizing mass usually will be placed is disclosed. The mass generally will fall somewhat closer to 45°, rather than the two extremes of FIGS. 7 and 8, as will be better appreciated later on when this disclosure is more fully digested. Furthermore, the spaced distance between axis 23 and the medial plane passing through the stabilizing mass can be varied in a manner indicated by the variations set forth in FIGS. 7 and 8.

Figure 9:
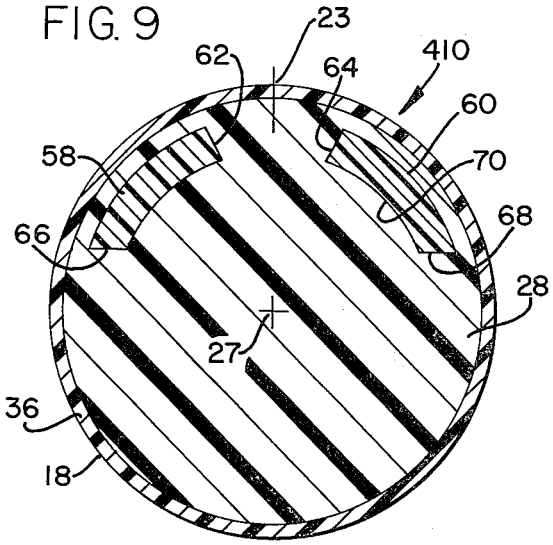
FIG. 9 is a cross-sectional view of still another embodiment of a bowling ball made in accordance with the present invention.

Looking now to the details of FIG. 9, there is disclosed a bowling ball 410 having two segments 58 and 60 of an annular member formed therein. The segments are spaced from one another and have a density which is substantially greater than the density of the main body. The cross-sectional configuration of the segments 58 and 60 can take on any number of different geometrical cross-sectional configurations, such as, for example, circular, square, triangular, and the like. The segments have the illustrated adjacent ends 62 and 64 equally spaced from the vertical axis 23, and the opposed ends 66 and 68 are equally spaced from the before mentioned adjacent ends. The minor diameter of the annular segments is indicated by numeral 70, and preferably is arranged closer to the surface of the ball as compared to the geometrical center 27 thereof.

Figure 10:
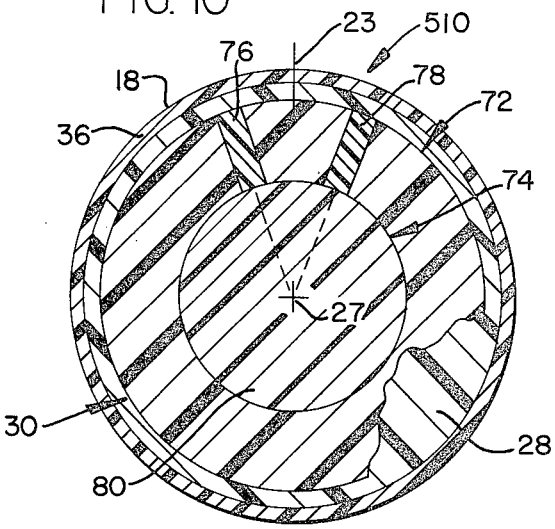
FIG. 10 is another cross-sectional view which discloses still another embodiment of the present invention; with some parts being broken away therefrom to more clearly illustrate the invention.

In the embodiment of FIG. 10, the bowling ball 510 is provided with an annular disk core 30, which is interrupted by the provision of two spaced apart, radially disposed, spokelike members 76 and 78. The spokelike members can be of any geometrical configuration, but preferably are made square and of the same thickness as the annular disk core 30 for ease of manufacturing. The density of the members 76 and 78 is greater than the density of the disk core which in turn is greater than the density of the main body 28. The density of the spherical core 80 is less than the density of the main body 28 to enable a final desired gross weight to be realized. The outer surface 74 of the spherical core can be adjusted as desired respective to the members 76 and 80 and respective to the outer surface of the ball.

It is contemplated to use a spherical core in any of the foregoing embodiments of the invention. Where the outer surface of the spherical core is near the top weight members, it is advantageous to support the top weights from the spherical core during manufacture of the ball.

Figure 11:
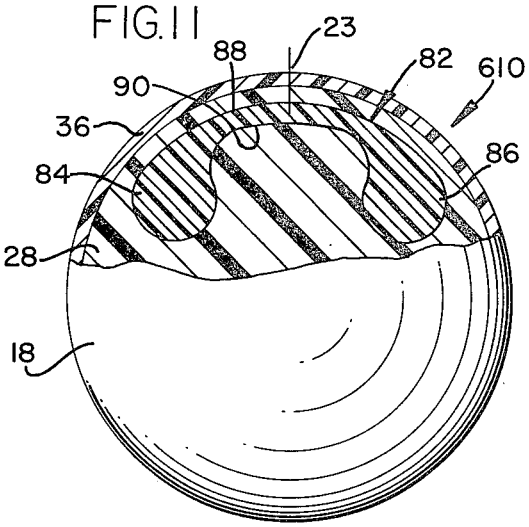
FIGS. 11 and 12 are part cross-sectional representations of other different embodiments of a bowling ball made in accordance with the present invention.

In the embodiment of FIG. 11, the stabilizing mass 82 is comprised of spaced apart enlargements 84 and 86 joined together by a bridge 88, which results in a cutout generally indicated by the numeral 90. The cross-sectional configuration of the stabilizing weight disclosed in FIG. 11 is analogous to that of a telephone. The bridge can be arranged adjacent to the outer covering if desired.

Figure 12:
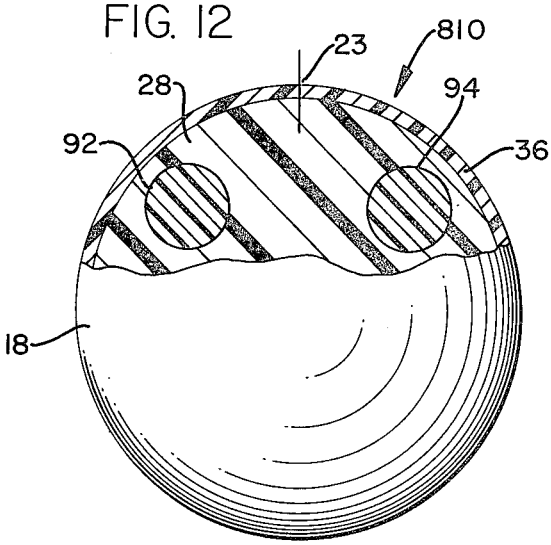

In the embodiment disclosed in FIG. 12, the stabilizing mass is comprised of two spaced, spherical members 92 and 94, which are equally spaced from the vertical axis 23. The spherical members are embedded within the main central body 28 and are arranged so that a line drawn from the geometrical center of each of the weights to the geometrical center of the ball forms an included angle between the limits of 45° to 90°. The members 92 and 94 may be arranged adjacent to the outer covering as desired.

Figure 13:
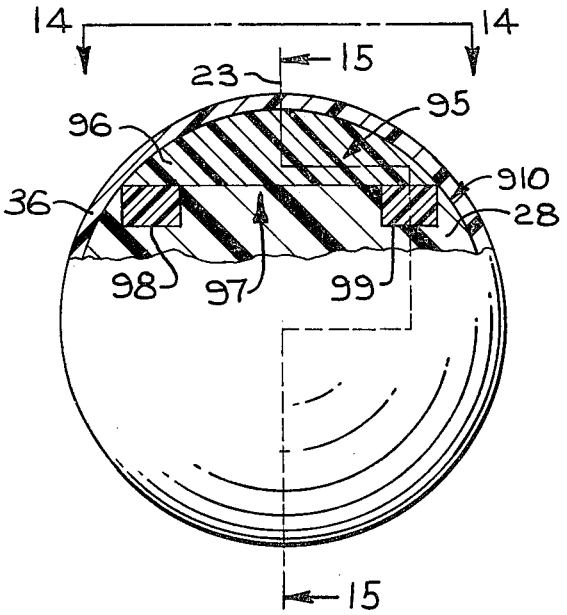
FIG. 13 is a cross-sectional view of a bowling ball showing another embodiment of the invention.
Figure 14:
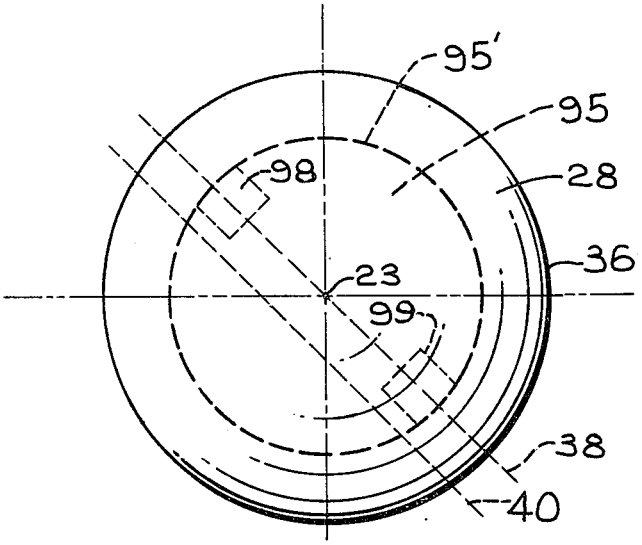
FIG. 14 is a top plan view of the ball disclosed in FIG. 13.
Figure 15:
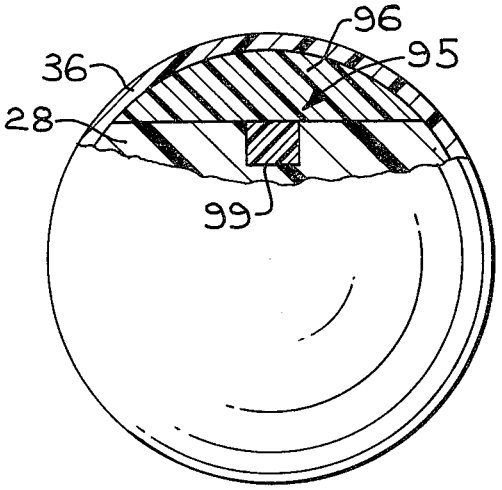
FIG. 15 is a hypothetical cross-sectional view of the ball disclosed in FIGS. 13 and 14, taken along the line 15—15.

In FIGS. 13–15, there is disclosed a stabilizing mass 95 comprising a top weight 96 which is a modified frustum or segment of a sphere. The segmented sphere includes a central portion 97 and at least one inwardly projecting stabilizing mass, such as seen disclosed at 98 and 99.

As best seen in FIG. 14, each of the stabilizing masses, 98 and 99, are aligned respective to the ball such that when the ball is properly rolled, the mass describes a plane which is normal to the rolling axis of the ball, and therefore parallel to the rolling plane of the ball.

As seen in FIGS. 13 and 15, the stabilizing mass projects inwardly of the ball and is of limited dimensions respective to the remainder of the top weight. It is contemplated to employ one or more masses in the form of the projections 98 and 99, with each of the projections being aligned along a plane which is coincident with or parallel to the planes 38 and 40.

The stabilizing mass 95 can be fabricated in a manner disclosed in Randolph, U.S. Pat. No. 3,270,108, by first casting or molding the segmented sphere, and adding thereto the inwardly projecting protrusions 98 and 99. The protrusions may be partially embedded within the spherical, crescent-like portion 96, if desired. It is preferred that the density of the plastic or rubberlike protrusions be greater than the main body 28, and that the density of the mass 96 be of a value which is intermediate the densities of the protrusions and the main body.

In each embodiment of Applicant's invention, it should be noted that a substantial portion of the weight of the ball has been redistributed into a stabilizing mass having a geometrical figure which describes either a disk, or annulus, or both a disk and an annulus as the ball is rotated about an axis normal thereto. The last named axis is the rolling axis of the bowling ball.

Those skilled in the art, having studied the present disclosure, will furthermore appreciate that the novel bowling ball of the present invention has advantageously had the weight thereof redistributed in such a manner that the compensating top weight, which heretofore has been provided for offsetting the loss in weight resulting from removal of material for the gripping holes, stabilizes the ball in a new and unexpected manner. The resultant bowling ball is therefore gyroscopingly stabilized by the rotating mass 30 when the ball is rotated about its rolling axis. Moreover, the weight distribution is such that the ball remains within the limits required for participating in competition.

However, in order to utilize the maximum advantage of the stabilizing mass, it is necessary for the gripping holes to be placed within the ball at a precise location, such that when a particular bowler releases the ball, the ball will commence rolling down the lane along a rolling plane indicated by the location of the dot-dash lines 38 and 40. It is believed that numeral 38 indicates the apparent rolling plane of a bowling ball, while a plane 40, which is parallel to and displaced therefrom, is the true rolling plane of the bowling ball. Accordingly, in practicing the present invention, it is essential that the stabilizing mass be placed such that it is parallel to either the true or apparent rolling plane of the ball.

Since newly manufactured bowling balls usually are devoid of gripping holes, it stands to reason that extreme difficulty may be involved in locating the proper relative position of the three gripping holes if advance precaution is not taken in overcoming this problem. This is so because very few bowlers release a bowling ball in the same exact manner. Individual bowlers characteristically impart various different motions into a bowling ball as it is released from their hands. Therefore, the arrangement or orientation of the gripping apertures 12-16 must be precisely located respective to the X-Y axis, as well as to the stabilizing mass. For this reason, indicia, such as a heart 24, indicates the most desirable central location for the gripping holes, while the arrow 26 indicates the plane within which the stabilizing mass is located. It is therefore necessary for the bowler to determine the exact rolling path of a ball respective to his grip pattern, in order for the apertures 12-16 to be precisely fabricated into a ball made in accordance with this invention, if maximum advantage is to be realized from the improved bowling ball.

One means by which this can be achieved is for the bowler to draw a circle about his old bowling ball which describes the rotational path of the ball when the ball initially leaves his hand. This must be carried out by trial and error procedure. Once the relationship of the pattern of gripping holes respective to the rolling path described about the old ball is established, this data can be readily transferred over onto the new ball of the present invention by utilizing the indicia at 24 and 26. In other words, the path described about the ball would lie somewhere between the path described by numerals 38 and 40 of FIG. 1. The grip pattern can then be accurately transferred over onto the ball of the present invention.

In the embodiments of the invention disclosed in FIGS. 1-6 and 9-12, the eccentric or top weight provided in proximity of the gripping holes represents the loss of material which results from formation of the apertures 12-16. Hence, in addition to the stabilizing mass of the present invention, the compensating weight of the prior art bowling balls has been advantageously rearranged so that the weight distribution within the interior of the ball is arranged to further stabilize the ball as it travels down the alley.

In addition to the unexpected stability achieved in a rolling ball, the present invention provides a ball which does not deflect from its path of travel upon striking a pin. Accordingly, the impact of the ball as it strikes the first pin will not change its path of travel and the ball can accordingly continue into contact with the next pin.

In the above different embodiments of the invention, the difference in the density of the top weight members is of a value to imbalance the ball an amount which compensates for the material to be removed for the formation of the gripping holes.

The present invention provides a solid bowling ball having a main body of relatively low density. The indicia 24, 26 is placed on the outer surface of the ball at a location which describes the vertical axial centerline 23 of the ball. The top weight 82, for example, underlies the indicia and is distributed along a weight plane 38. The weight plane intersects the geometrical center 27 of the ball. The indicia indicates the location of the center of the top weight mass and the relative location and orientation of the weight plane.

The equatorial plane of the ball intersects the geometrical center 27 thereof and is circumscribed equidistant from the indicia and from the center of mass of the top weight. All of the top weight is located above the equatorial plane and is divided into two major, spaced apart masses such as seen at 92 and 94, for example. The spaced apart masses are equal in weight and are placed equidistant from the vertical axis and from the equatorial plane.

Most of the mass of the top weight is distributed circumferentially about the weight plane as contrasted to the weight distribution in a direction normal to the weight plane, such that when the ball is rolled, to describe a rolling plane 38 or 40 which is parallel to the weight plane, the top weight produces a gyroscopic effect because it has effectively been arranged circumferentially longer as compared to its width.

The gripping holes 12, 14, 16 are formed asymmetrically respective to the weight plane and symmetrically respective to the indicia and to the X and Y planes. That is, the intersecting planes 20, 22 are defined by and therefore are symmetrical respective to the gripping holes as illustrated in FIG. 1. The weight plane intersects the vertical central axis and is arranged at an angle respective to the X and Y axis. Hence, the top weight is located respective to each quadrant such that when the finger holes are formed, the resultant weight of the ball is substantially equal in each of the four quadrants. The weight of the completed ball on either side of the X and Y axis must be within one ounce of one another, and this weight distribution is considered to fall within the term "substantially equal", since the entire ball weighs up to 16 pounds.

I claim:

1. A solid bowling ball having a main body of a relatively low density, means forming indicia on the outer surface of said ball at a location which describes the vertical axial centerline of the ball, a top weight underlying said indicia which offsets the loss in weight resulting from the subsequent formation of finger holes;

the mass of said top weight being distributed along a weight plane which intersects the geometrical center of the ball, said indicia indicates the location of the center of mass of said top weight and the relative position of said weight plane;

the equatorial plane of the ball intersects the geometrical center thereof and is circumscribed equidistant from said indicia and from the center of mass of said top weight; all of said top weight being located above said equatorial plane and being divided into two major spaced apart masses with each of the spaced apart masses lying equidistant from said vertical axis and from said equatorial plane; with most of the top weight being distributed circumferentially about said weight plane as compared to the distribution of said top weight in a direction normal to said weight plane such that when the ball is rolled to describe a rolling plane which is parallel to said weight plane, the top weight produces a gyroscopic effect.

2. The ball of claim 1 wherein finger holes are formed asymmetrically respective to said weight plane and symmetrically respective to said indicia such that the indicia lies between the two finger holes and the thumb hole, while the weight planes lies 30° to 60° respective to a line which bisects the thumb hole and extends between the finger holes.

3. The ball of claim 1 wherein said top weight is located respective to each quadrant drawn through the central axis and normal to the equatorial plane such that the weight distribution of the top weight respective to each quadrant of the ball is substantially equal.

4. The ball of claim 3 wherein said top weight is two spaced apart bodies which are identical in mass.

5. A solid spherical bowling ball of a relatively low density having a vertical central axis which is perpendicular to and intersects an equatorial plane, and an X and Y plane placed normal to one another which intersect along said vertical central axis and which lie normal to said equatorial plane; means forming indicia on said ball which is related to the location and orientation of a thumb and two finger holes which are to be subsequently formed such that the Y plane will bisect the thumb hole and continue equidistant between the finger holes, while the X plane extends along a line drawn equidistant between the thumb hole and the finger holes;

a top weight of relatively high density underlying said indicia which offsets the loss in weight resulting from the subsequent formation of the finger and thumb holes;

the mass of said top weight being distributed along a weight plane which lies parallel to a plane which bisects the vertical central axis of the ball and which lies angularly disposed from either of said X and Y planes;

all of said top weight being located above said equatorial plane and being divided into two major spaced apart masses with each of said spaced apart masses lying equidistant from said vertical axis and from said equatorial plane; most of the mass of said top weight being distributed circumferentially about said weight plane as compared to the weight distribution of said top weight in a direction normal to said weight plane to effect an elongated, narrow, isolated mass which produces a gyroscopic effect when the ball is rolled along a rolling axis situated normal to the weight plane;

said indicia being related to the location and orientation of said top weight so that the finger holes can be subsequently formed at a location which causes the ball to roll along about an axis normal to said weight plane, thereby effecting said gyroscopic action.

6. The ball of claim 5 wherein said top weight is located respective to said X and Y axis such that when finger holes are subsequently formed in the ball, the presence of the top weight produces substantially no variation of weight on either side of the X and Y planes.

7. The ball of claim 5 wherein said top weight includes two spaced bodies which are identical in mass, with each of said bodies being spaced from and equidistant from the overlying said indicia.

8. A solid bowling ball having a main body of a relatively low density, finger holes formed into said ball, and a top weight immediately underlying said finger holes which offset the loss in weight resulting from the formation of said finger holes;

the mass of said top weight being distributed circumferentially along a first plane which is parallel to another plane lying along the axial vertical centerline of said ball;

said top weight being two spaced masses located above the equatorial plane of the ball and adjacent to said finger holes such that the top weight commences and ends with less than 180° of curvature; said two spaced masses being equidistant from said equatorial plane and from said indicia; with the resultant top weight being so elongated and narrow that when rolled, the weight produces a gyroscopic effect; and, means by which said finger holes are oriented respective to said first plane and to said weight to cause said ball to normally assume a rolling plane which is parallel to said first and another plane when rolled by a bowler.

9. The ball of claim 8 wherein said top weight is located respective to each quadrant drawn through the central axis and normal to the equatorial plane such that the weight distribution of the ball respective to each quadrant is substantially equal.

10. The ball of claim 8 wherein said top weight is two spaced apart bodies which are identical in mass, and which lie distributed along a weight plane which is normal to the rolling axis of the ball, with most of the mass of the top weight extending circumferentially about said weight plane as compared to the mass distribution of said top weight in a direction normal to said weight plane;

said finger holes are formed asymmetrically respective to said weight plane and symmetrically respective to said indicia such that the indicia lies between the two finger holes and the thumb hole, while the weight planes lies 30° to 60° respective to a line which bisects the thumb hole and extends between the finger holes.

* * * * *